US008158272B2

(12) United States Patent
Hermes

(10) Patent No.: US 8,158,272 B2
(45) Date of Patent: Apr. 17, 2012

(54) SHEET PILE IN DOUBLE-T FORM

(75) Inventor: Aloyse Hermes, Differdange (LU)

(73) Assignee: Arcelormittal Commercial RPS S.A.R.L., Luxembourg (LU)

( * ) Notice: Subject to any disclaimer, the term of this patent is extended or adjusted under 35 U.S.C. 154(b) by 803 days.

(21) Appl. No.: 12/161,008

(22) PCT Filed: Dec. 19, 2006

(86) PCT No.: PCT/EP2006/069920

§ 371 (c)(1),
(2), (4) Date: Jul. 16, 2008

(87) PCT Pub. No.: WO2007/082619

PCT Pub. Date: Jul. 26, 2007

(65) Prior Publication Data

US 2010/0151269 A1 Jun. 17, 2010

(30) Foreign Application Priority Data

Jan. 17, 2006 (DE) ..... 10 2006 002 241
Mar. 9, 2006 (LU) ..... 91 227

(51) Int. Cl.
*E02D 5/02* (2006.01)
*E02D 5/03* (2006.01)
*E02D 5/04* (2006.01)

(52) U.S. Cl. ..... 428/598; 428/600; 405/274; 405/276; 405/277; 405/279

(58) Field of Classification Search ..... 405/277, 405/274, 276, 279; 428/600, 573, 609; 52/309.11, 52/426, 562; 403/122, 76, 339, 340
See application file for complete search history.

(56) References Cited

U.S. PATENT DOCUMENTS 850,043 A * 4/1907 Nye ..... 405/278
2,018,625 A * 10/1935 Grave ..... 405/277

FOREIGN PATENT DOCUMENTS

| | | |
|---|---|---|
| DE | 613 210 | 2/1936 |
| DE | 28 19 737 | 11/1979 |
| DE | 103 39 957 | 1/2005 |
| GB | 2 071 188 | 9/1981 |
| JP | 02 066215 | 3/1990 |
| JP | 08 100422 | 4/1996 |
| JP | 2004 232225 | 8/2004 |
| WO | 2005/038148 | 4/2005 |

OTHER PUBLICATIONS

Arcelor RPS, "Piling Handbook", 8th Edition, Jan. 2005, p. 30 and 58-59.*

International Search Report; PCT/EP2006/069920; Apr. 3, 2007.

* cited by examiner

*Primary Examiner* — Jennifer McNeil
*Assistant Examiner* — Clarisa M Carrizales
(74) *Attorney, Agent, or Firm* — Cantor Colburn LLP

(57) ABSTRACT

A steel sheet pile in double-T form includes a web and two flanges, in which each flange has an inner side facing the web, an outer side facing away from the web, and two longitudinal edges, and also coupling means for a connection profile along at least one longitudinal edge of at least one flange. In a first embodiment, the coupling means are formed by a groove which extends in the outer side of at least one flange along at least one longitudinal edge.

21 Claims, 6 Drawing Sheets

Fig. 1
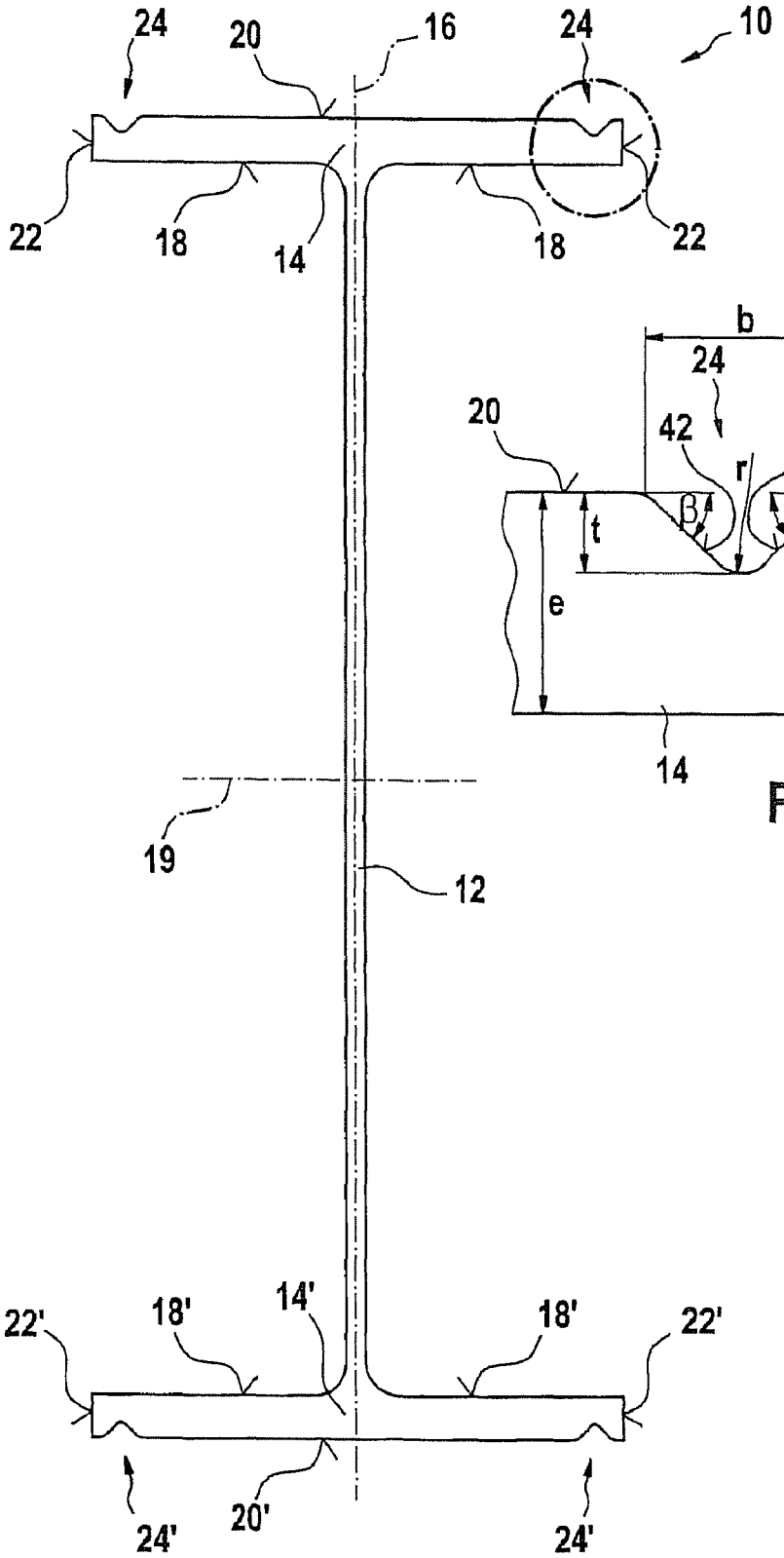
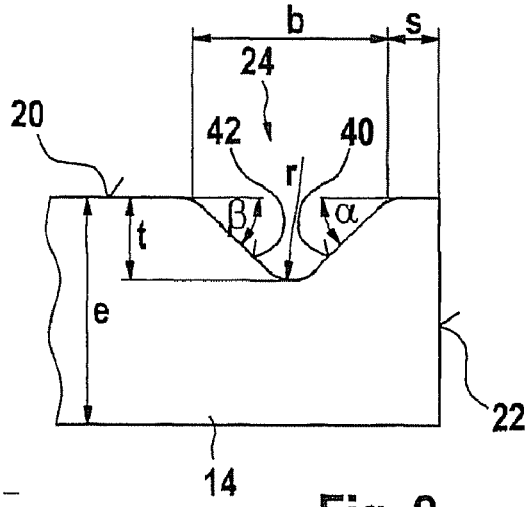
Fig. 2

SHEET PILE IN DOUBLE-T FORM

TECHNICAL FIELD OF THE INVENTION

The present invention generally relates to a sheet pile in double-T form, having a central web and two flanges, and also coupling means for a connection profile along at least one longitudinal edge of at least one flange. It also relates to a sheet pile of this type comprising at least one coupled connection profile.

BRIEF DESCRIPTION OF RELATED ART

Such a steel sheet pile in double-T form was described as early as 1936 in patent DE 613 210. In this sheet pile the coupling means are formed by wedge-shaped thickened portions at the outer side of the flange ends. The associated connection profile comprises a clamp-shaped lock part which is pushed over a flange end with its wedge-shaped thickened portion, a positive connection being produced between the flange end and connection profile.

Sheet piles in double-T form in which the coupling means are formed by wedge-shaped coupling beads which extend on the outer side of the flanges along their longitudinal edges are today produced by Peiner Träger GmbH under the name "Peiner Stahlpfähle PSt" and by ARCELOR RPS under the designation "HZ King Piles". The coupling beads have a wedge angle of approximately 45° and, depending on the size of the sheet pile, have a height between 15 mm and 20 mm.

Associated connection profiles have, as in the case of the connection profiles from patent DE 613 210, a clamp-shaped first lock part which is pushed over a flange end with its wedge-shaped coupling bead. This first lock part comprises an inwardly curved, upper strip which engages around the wedge-shaped coupling bead on the flange outer side, and a straight, lower strip which bears against the flange inner side. A second lock part of the connection profile then makes it possible to couple a flange end of a further sheet pile in double-T form to the connection profile, or to couple thereto a U-shaped or Z-shaped sheet pile so as to form "mixed" sheet-pile walls (see, for example, DE 28 19 737).

To increase the section modulus of known sheet profiles in double-T form, DE 103 39 957 proposes that the flange between the coupling end portions which bear the wedge-shaped coupling beads be arched convexly. Here, the thickened portion on the outer side of the flange is intended to taper progressively in the direction of the longitudinal edges of the flanges.

WO 2005/038148 likewise proposes increasing the section modulus of sheet piles in double-T form by thickening the outer side of the flanges, starting at a defined distance from their longitudinal edges, so that there remain tapered flange ends which bear the coupling means.

Known steel sheet piles in double-T form having wedge-shaped coupling beads are produced by hot rolling. However, achieving a uniform formation of the wedge-shaped coupling beads during the hot-rolling operation is not without problems. To ensure that the coupling beads all have the same height, it is known for example to roll them with a certain excess height and subsequently trim them to the desired height using a cutting torch. However, this finishing operation on the steel sheet piles in double-T form entails significant costs and may furthermore lead to damage to the flange outer side. It also frequently occurs that a coupling bead is incompletely formed and subsequently has to be manually reworked by deposition welding.

It is also known practice for a connection profile as described above, which has already been positively connected to the flange end, to be additionally welded to the flange ends. For this purpose, a weld seam is laid between the terminal edge of the upper, or lower, strip of the connection profile and the outer side, or inner side, of the flange. However, producing this weld seam is not without problems if a relatively large gap is formed between the terminal edges of the strips and the flange surface. However, given the relatively wide manufacturing tolerances for the connection profiles and the sheet piles, this situation arises relatively frequently.

BRIEF SUMMARY OF THE INVENTION

The invention provides a sheet pile in double-T form comprising coupling means for a connection profile along at least one longitudinal edge of at least one of its flanges, the intention being to be able to be produce these coupling means more simply than the wedge-shaped coupling beads known hitherto.

The present invention accordingly relates to a steel sheet pile in double-T form, comprising a central web and two flanges, in which each flange has an inner side facing the web, an outer side facing away from the web, and two longitudinal edges, and also coupling means for a connection profile along at least one longitudinal edge of at least one flange.

According to a first aspect of the present invention, the coupling means are formed by a groove which extends in the outer side of at least one flange of at least one longitudinal edge. In other words, the coupling means are no longer formed by a thickening of the flange end, or by a wedge-shaped coupling bead, but by a groove which is incorporated into the flange end along the longitudinal edge. The associated connection profile here can advantageously have a clamp-shaped lock part with an inwardly curved strip which engages at the flange outer side into the groove of the flange. Such a groove can be formed far more simply, i.e. more reliably, for example in the course of hot rolling the double-T sheet pile, than is the case with a wedge-shaped coupling bead on the flange outer side. Furthermore, it is additionally possible for the groove to be incorporated subsequently into the flange of a completed double-T profile. This can be carried out for example in a machining operation, by milling or planing. It is also possible in a relatively straightforward manner for a groove that has already been rolled in to be finished mechanically, for example by milling, planing or grinding.

In a preferred embodiment, the groove has a substantially V-shaped cross section with a preferably rounded bottom. However, the groove bottom can also be flattened off.

The dimensions of the groove can advantageously be set as follows. If the flange has a thickness e in the direct vicinity of the groove, and b is the opening width of the groove, then $(0.5\cdot e)\leqq b\leqq(1.5\cdot e)$, preferably $(0.9\cdot e)\leqq b\leqq(1.1\cdot e)$. If t is the depth of the groove, then $10\text{ mm}\leqq t\leqq(0.5\cdot e)$. If s is the distance from the longitudinal edge of the flange, then $4\text{ mm}\leqq s\leqq 12\text{ mm}$. If $\alpha$ is the angle defined by the first groove flank situated closest to the longitudinal edge of the flange with the flange outer side, then $40°\leqq\alpha\leqq 50°$. If $\beta$ is the angle defined by a second groove flank opposite the first with the flange outer side, then $40°\leqq\beta\leqq 90°$, but preferably $40°\leqq\beta\leqq 50°$.

The steel sheet pile in double-T form may have a constant thickness over its entire width. However, it may also have one or more thickened flange ends, in which case the groove can be arranged in one of the thickened flange ends, or may have one or more tapered flange ends, in which case the groove can be arranged in one of the tapered flange ends. In principle, the thickness of the flange end is determined by the inner width "w" of the clamp-shaped lock part which is to be coupled on.

Furthermore, at least one flange may have a groove in its inner side, along at least one longitudinal edge. If a flange end has a groove both in its outer and inner side, these grooves may have a smaller depth. In addition, the clamp-shaped lock part may be formed symmetrically, thereby making it possible, for example, to couple Z-shaped sheet piles having a Larssen lock using a single connection profile. Furthermore, the double groove also allows a certain rotation of the connection profile relative to the flange end, making it possible to achieve fewer angled sections in the sheet-pile wall.

The sheet pile may be a hot-rolled profile or a welded-together profile in which the flanges are formed by hot-rolled wide steel flats and the web is formed by a steel plate.

A preferred connection profile has a clamp-shaped lock part which is pushed over the longitudinal edge with the adjacent groove, in which the groove has a first groove flank situated closest to the longitudinal edge of the flange and a second groove flank situated opposite the first, and the clamp-shaped lock part has an inwardly curved strip which engages at the flange outer side into the groove of the flange and has a terminal edge which is situated directly opposite the second groove flank. It is then possible in a simple and secure manner for a weld seam to be laid in the wedge-shaped gap which is formed between the second groove flank and an outer side of the terminal edge. The terminal edge of the inwardly curved strip has a centre plane which is preferably approximately perpendicular to the second groove flank and intersects the second groove flank approximately in its centre.

The clamp-shaped lock part preferably forms a lock chamber which is rearwardly bounded by a lock rear wall which is situated opposite the longitudinal edge of the flange. The size of this lock chamber defines the size and position of the groove in the flange. It should preferably be ensured here that the lock rear wall is at a distance of 1 mm to 5 mm from the longitudinal edge of the flange if the terminal edge bears against the second groove flank. It should also be ensured that the terminal edge is at a distance of less than 5 mm from the second groove flank if the lock rear wall bears against the longitudinal edge of the flange.

According to a second aspect of the present invention, the coupling means are formed by a coupling bead produced by deposition welding. This deposition welding can be carried out in a fully automated manner and therefore requires relatively little effort. It is therefore possible for hot-rolled double-T profiles which have been rolled without coupling means on the flange ends to be converted to double-T sheet piles subsequently by deposition welding of a coupling bead along at least one longitudinal edge of at least one flange. It is also possible to apply the coupling beads to wide steel flats by deposition welding and then weld these flats together with a web plate to form a double-T sheet profile.

BRIEF DESCRIPTION OF THE FIGURES

Further details and advantages of the invention can be taken from the description given below of possible embodiments of the invention with reference to the appended figures, in which:

FIG. 1 shows a cross section of a sheet pile in double-T form;

FIG. 2 shows an enlarged detail from FIG. 1;

DETAILED DESCRIPTION OF THE INVENTION

Figure 3:
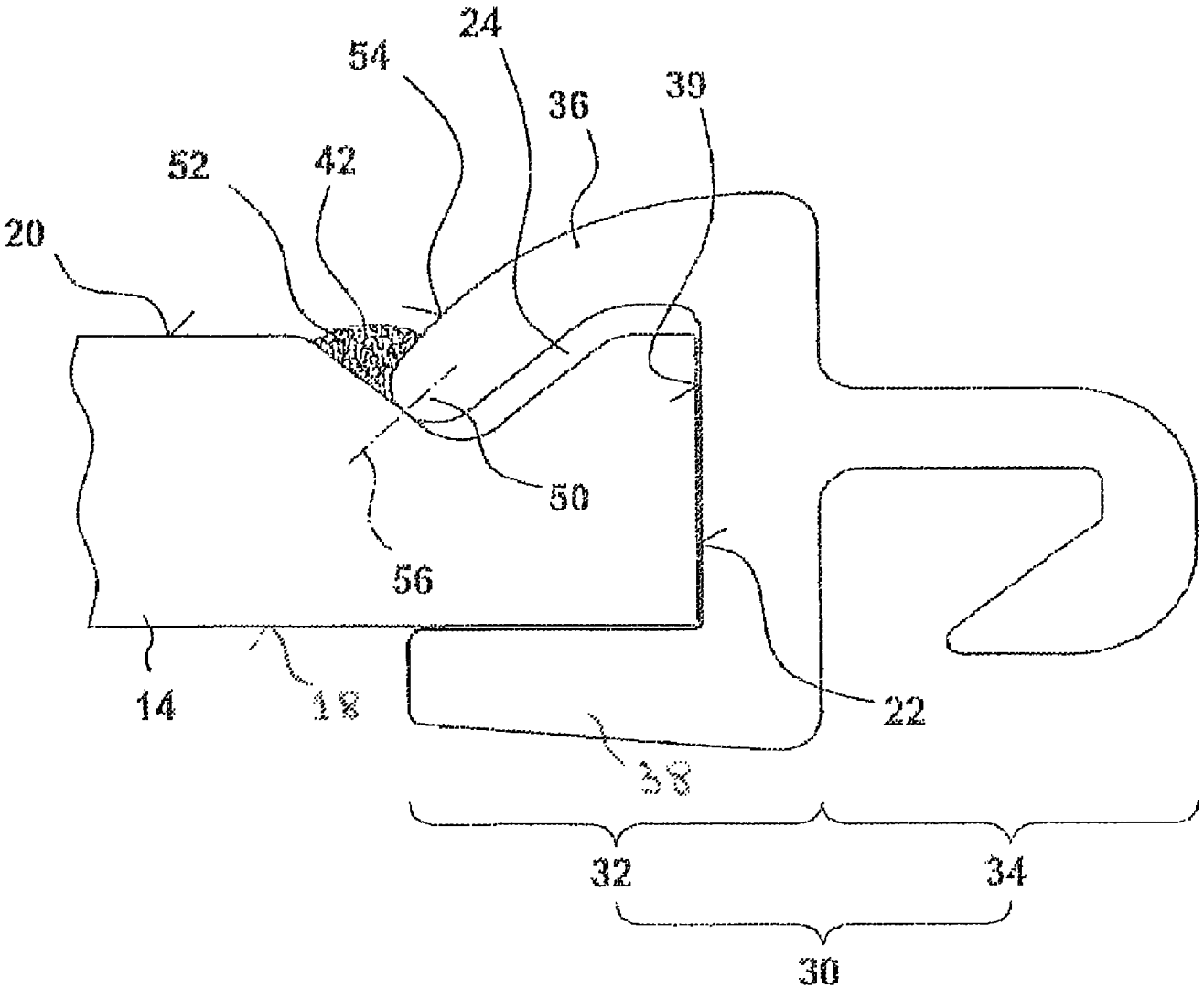
FIG. 3 shows a cross section through a first embodiment of a flange end, with a connection profile fastened thereto.

The steel sheet pile 10 in double-T form shown in FIG. 1 comprises a web 12 and two flanges 14, 14'. A first plane of symmetry 16 of the sheet pile 10 is formed by the centre plane of the web 12. A second plane of symmetry 19 extends between the two flanges 14, 14' perpendicularly to the first plane of symmetry 16. The sides of the flanges 14, 14' that face the web 12 are termed flange inner sides 18, 18'. The sides of the flanges 14, 14' that face away from the web 12 are termed flange outer sides 20, 20'. The flange outer sides 20, 20' are substantially planar and perpendicular to the first plane of symmetry 16. In the embodiment shown, the flange inner sides 18, 18' are parallel to the flange outer sides 20, 20'. However, similarly to "Peiner steel piles", the flange inner sides 18, 18' could also form an angle of more than 90° with the plane of symmetry 16. The reference numbers 22, 22' have been used to denote the longitudinal edges of the flanges 14, 14'.

Such a profile in double-T form can be produced as a hot-roll profile, with the web 12 and flanges 14, 14' being produced in a known manner in a universal roll stand. However, the web 12 and the two flanges 14, 14' can also be rolled as iron flats and then be welded together.

It can be seen from FIG. 1 that each flange 14, 14' is provided in its flange outer side 20, 20' with a respective groove 24, 24' along its longitudinal edge 22, 22'.

As is evident from FIG. 3, these grooves 24, 24' are intended for fastening a connection profile 30 to the longitudinal edges 22, 22' of the flanges 14, 14'. The connection profile 30 shown in FIG. 3 is, for example, a connection profile of the RZD type from ARCELOR RPS. On one of its sides, it comprises a clamp-shaped lock part 32, which is pushed over one of the longitudinal edges 22, 22' of one of the flanges 14, 14', and, on its other side, a lock part 34 to which can be coupled a further sheet pile, in this case, for example, a sheet pile with a Larssen lock. The clamp-shaped lock part 32 comprises an inwardly curved strip 36 which engages at the flange outer side 20 into the groove 24 of the flange 14, and a straight strip 38 which bears flat against the inner side 18 of the flange 14. The two strips 36, 38 define a lock chamber which is bounded rearwardly by a lock rear wall 39.

Before a further description is given of FIG. 3, there will now first be a given a more detailed description of the geometry of one of the grooves 24, 24' with reference to FIG. 2. The groove 24, which is arranged in a flange end having a thickness "e", has a substantially V-shaped cross section, although the groove bottom is advantageously rounded. It normally has an opening width "b" which is dimensioned such that $(0.5\cdot e) \leqq b \leqq (1.5\cdot e)$, preferably $(0.8\cdot e) \leqq b \leqq (1.1\cdot e)$, with normally 20 mm$\leqq$b$\leqq$45 mm. The distance "s" between the groove 24 and the flange edge 22 normally measures between 4 mm and 10 mm. The depth "t" of the groove is normally dimensioned such that 10 mm$\leqq$t$\leqq(0.5\cdot e)$. The first groove flank 40 situated closest to the flange edge 22 makes an angle $\alpha$ with the flange outer side 20 that measures between 40° and 50° and is preferably 45°. The second groove flank 42 situated opposite the first makes an angle $\beta$ with the flange outer side 20 that measures between 40° and 90°, preferably between 40° and 50°. The radius of curvature "r" of the groove bottom normally measures between 6 mm and 12 mm.

As is evident in FIG. 3, the inwardly curved strip 36 of the cup-shaped lock part 32 has a terminal edge 50 which is situated directly opposite the second groove flank 42. This makes it possible in a straightforward and reliable manner to produce a welded joint between the inwardly curved strip 36 of the connection profile 30 and the flange 14. This welded joint is produced by a weld seam 52 which is laid in a wedge-shaped gap which is formed between the second groove flank 42 and an—advantageously rounded—outer side 54 of the terminal edge 50.

As is also evident from FIG. 3, the terminal edge 50 of the inwardly curved strip 36 has a centre plane 56 which is approximately perpendicular to the second groove flank 42 and intersects the latter approximately in its centre. FIG. 3 here shows the ideal case in which the rounded terminal edge 50 bears against the second groove flank 42, and the clearance between the longitudinal edge 22 of the flange 14 and the lock rear wall 39 is only 1-2 mm (and should not be greater than 5 mm). However, the rounded terminal edge 50 may be at a distance of up to 5 mm from the second groove flank without resulting in any serious problems with the production of the weld seam 52.

The groove 24 shown in FIG. 3 can be produced very simply during the hot-rolling of the double-T profile. For this purpose, the rolls used to roll the flanges are only required to have corresponding beads. However, the groove 24 may also be incorporated subsequently in the flange 14. This can take place, for example, in a machining operation, by milling or planing. It is of course also possible for a groove which has already been rolled in to be finished mechanically, for example by milling, planing or grinding. In the case of a welded-together double-T profile, the grooves 24, 24' can be rolled into the flat profile which is to form the flanges 14, 14'.

Figure 4:
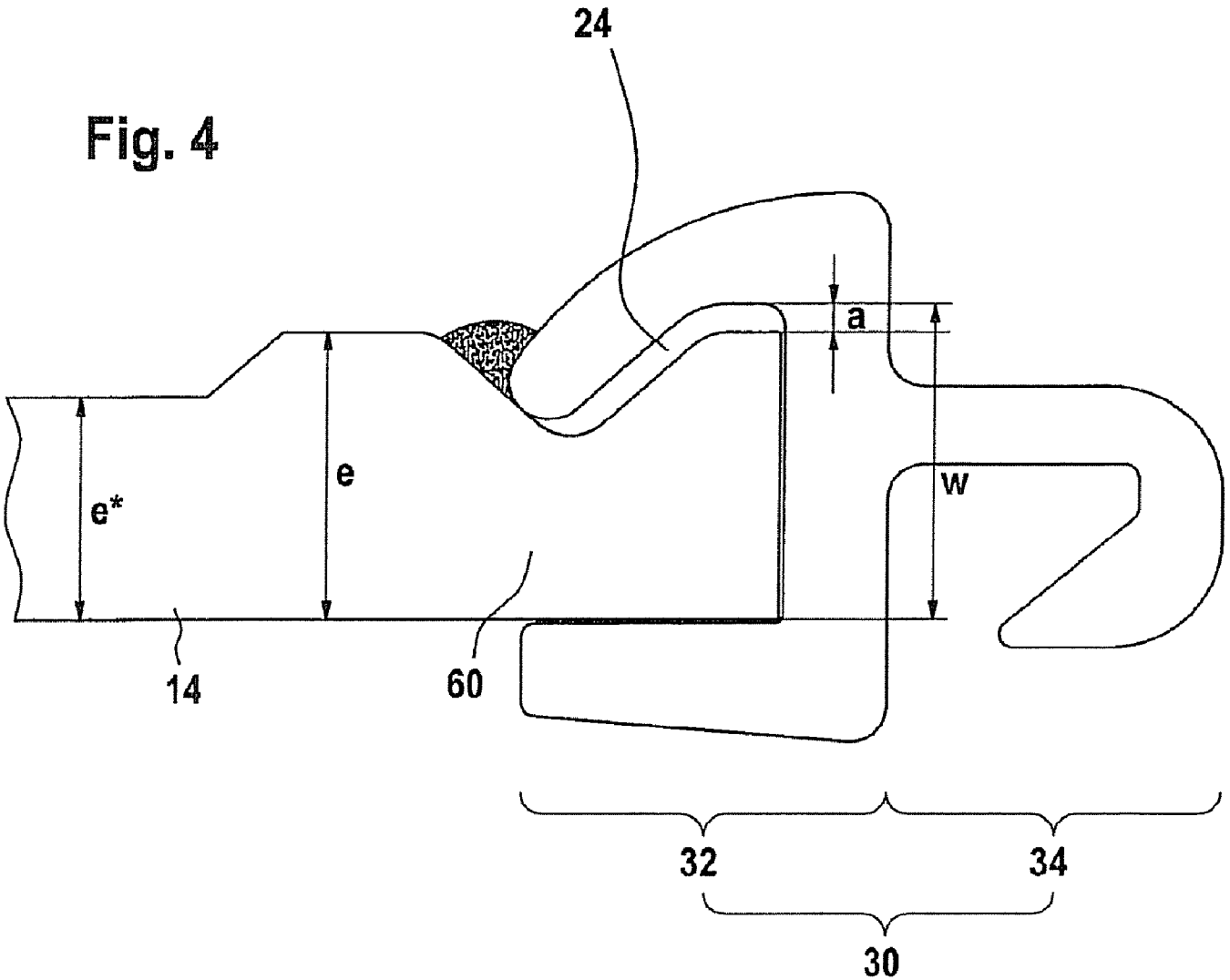
FIG. 4 shows a cross section through a second embodiment of a flange end, with a connection profile fastened thereto.

FIG. 4 shows an embodiment in which the groove 24 is incorporated in a thickened end 60 of a flange. The thickness "e" of the thickened end 60 is in this case made to match the inner width "w" of the clamp-shaped lock part 32, i.e. e=w−a, with normally 2 mm≦a≦8 mm. The thickness "e*" of the remainder of the flange can then be made smaller if the thickness "e" would result in an unnecessary excess of material in the remainder of the flange 14. Of course it would also be possible for "e" to be smaller than "e*", i.e. for a thick flange to be produced to whose tapered end is to be coupled a clamp-shaped lock part 32 having a smaller lock chamber inner width "w".

Figure 7:
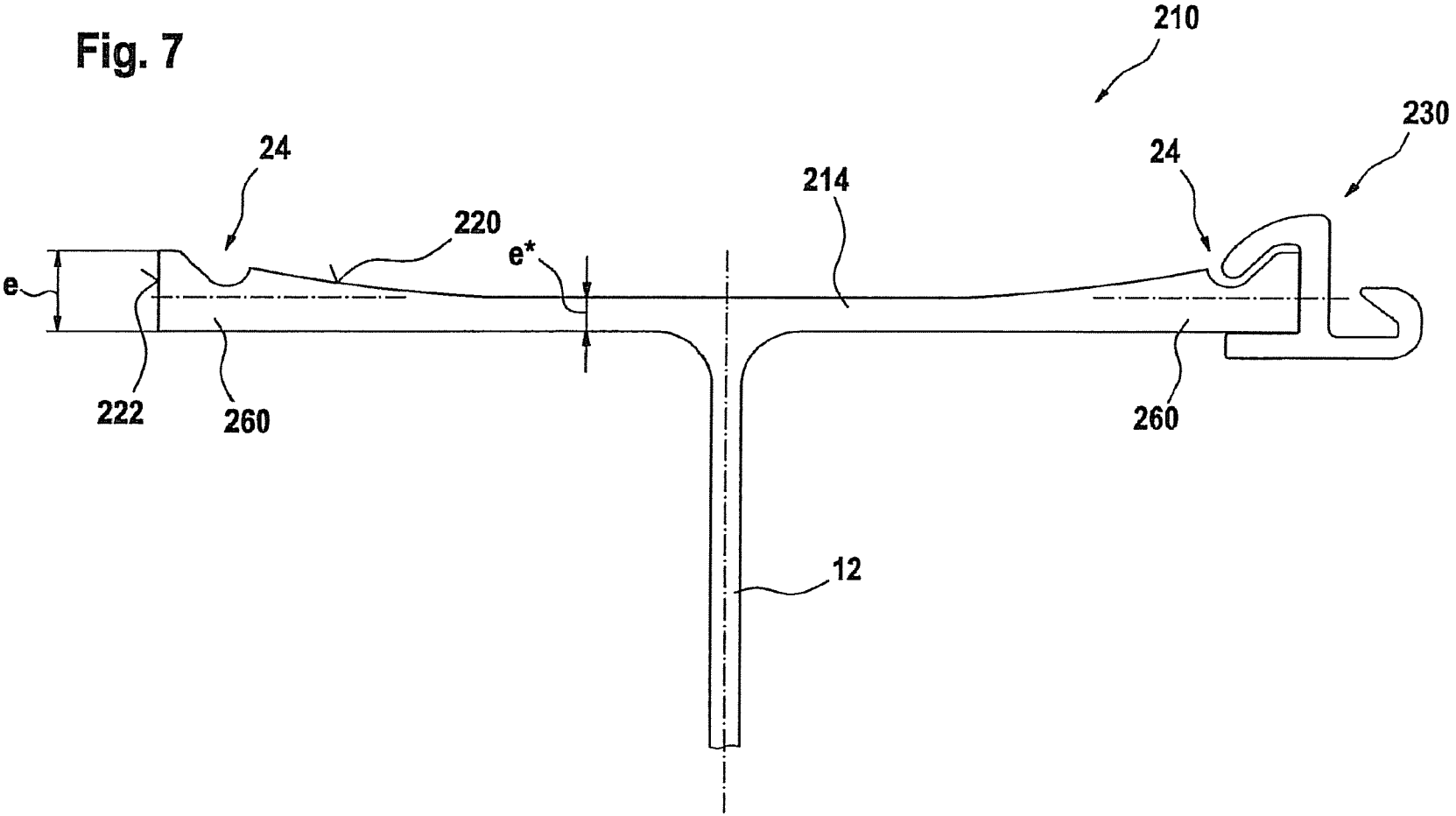
FIG. 7 shows a cross section through a further embodiment of a flange, with a connection profile fastened thereto.

FIG. 7 shows a variant embodiment relating to the thickened flange ends 60 shown in FIG. 4. The flange ends 260 of the double-T profile 210 shown in FIG. 7 are thickened in a wedge shape towards the outer side 220 and in this case have their maximum thickness "e" at the longitudinal edges 222 of the flange 214. As in the embodiment shown in FIG. 4, this thickness "e" is made to match the inner width "w" of the clamp-shaped lock part which is coupled to the flange end. The grooves 24 are incorporated, for example by rolling, milling or planing, in these flange ends 260 which are thickened in a wedge shape. The flange 214 has its minimum thickness "e*" towards the centre, i.e. towards the web 12. It will be observed that in the advantageous embodiment shown in FIG. 7 the outer side 220 of the flange 214 is substantially concave, i.e. curved inwardly. Such a concave outer side 220 can in fact be rolled relatively easily and also results in a reduction in the penetration resistance when driving the sheet pile 210 into the ground.

Figure 6:
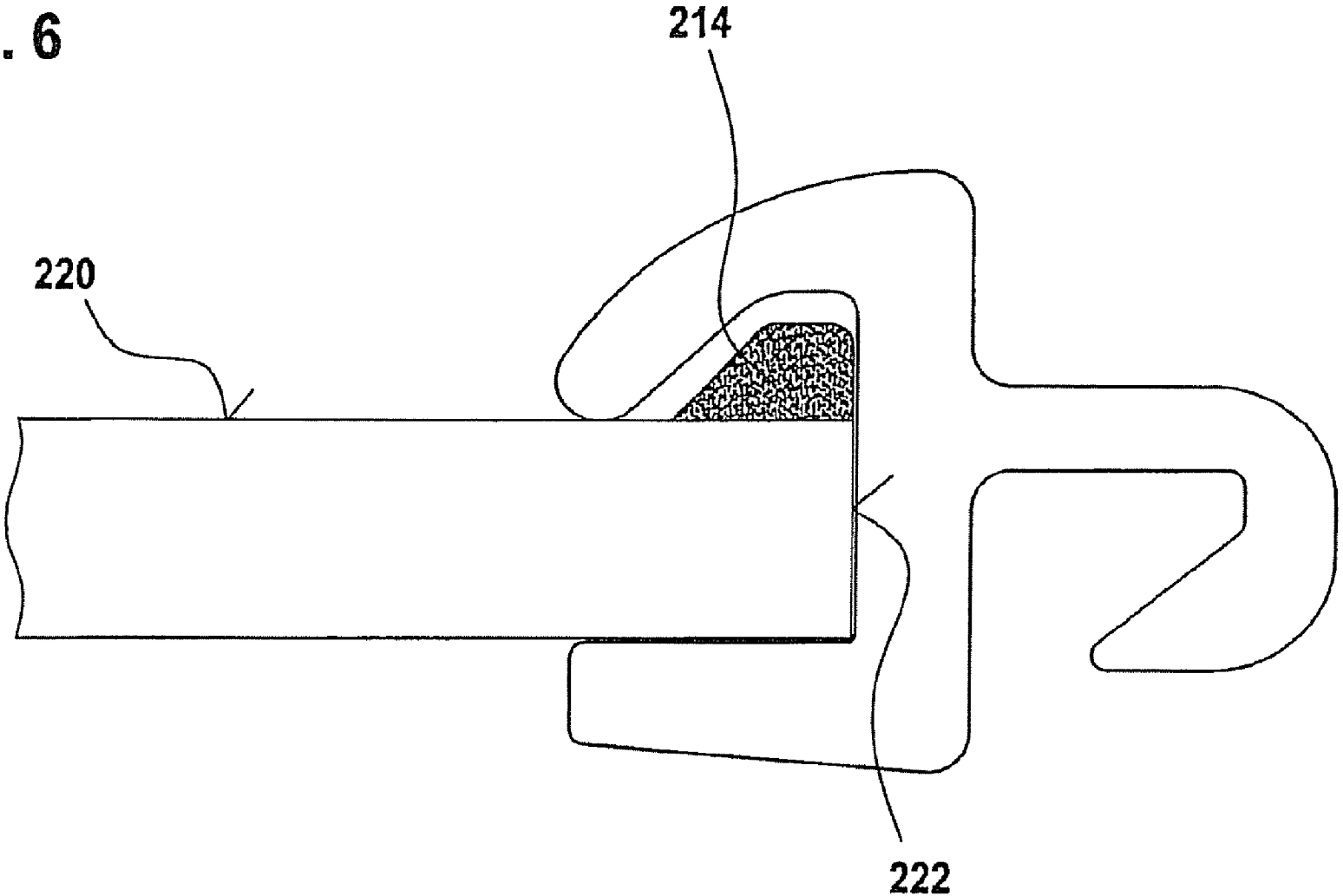
FIG. 6 shows a cross section through a variant of a flange end that represents a first, alternative solution.

It will be noted that the exemplary embodiment shown in FIGS. 3, 4 and 6 is a connection profile 30 of the RZD type from ARCELOR RPS. This connection profile can be readily exchanged for a connection profile of the RZU type or of the RH type from the delivery range of ARCELOR RPS, these types differing from the connection profile of the RZD type only in terms of the configuration of the second lock part 34. FIG. 7 shows, for example, a connection profile 230 of the RZU type from ARCELOR RPS. Of course, it is also possible to use other connection profiles as long as they have a clamp-shaped lock part which is pushed over a longitudinal edge with an adjacent groove, an element of the clamp-shaped lock part engaging into this groove.

Figure 5:
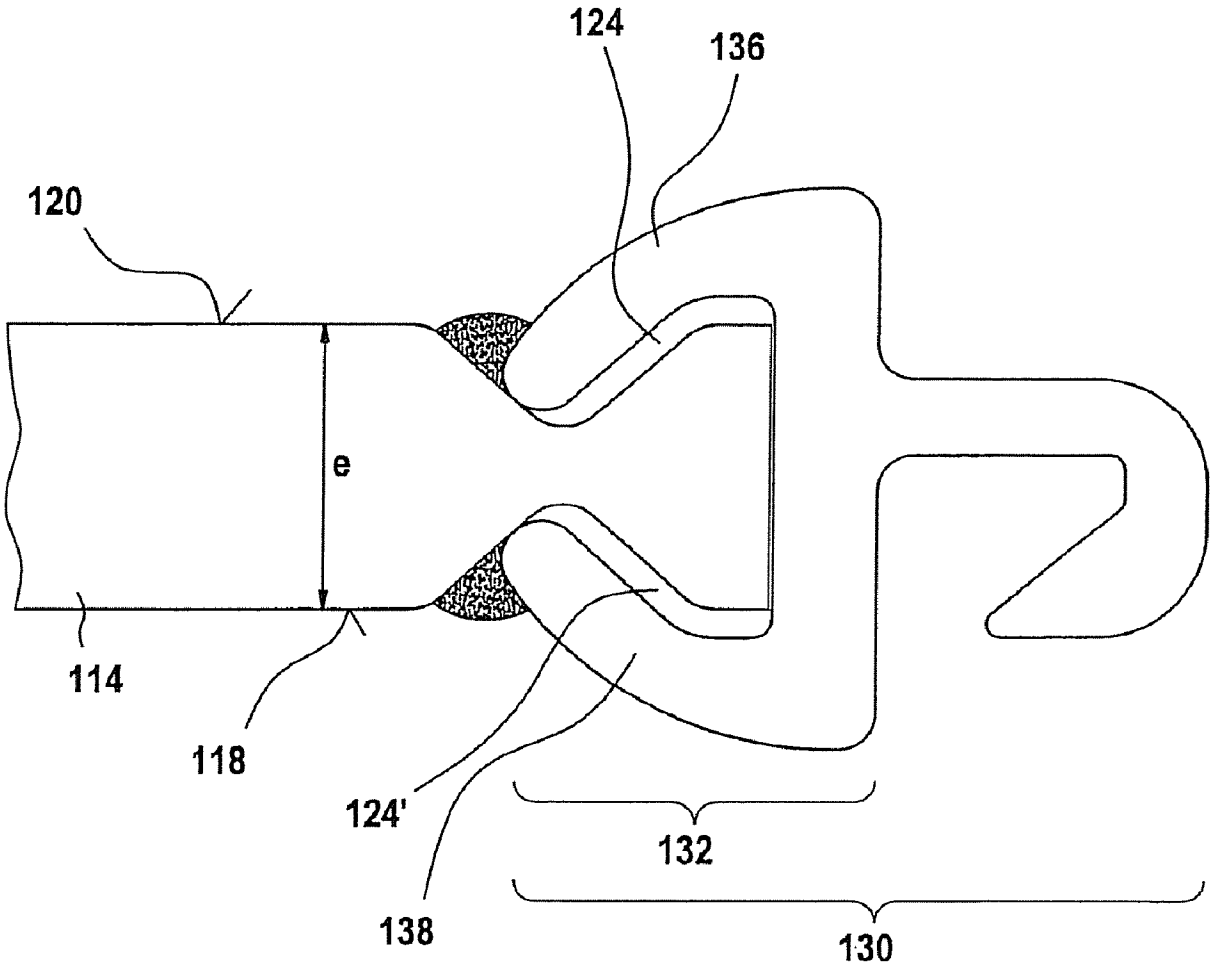
FIG. 5 shows a cross section through a third embodiment of a flange end, with a connection profile fastened thereto.

FIG. 5 shows an embodiment in which the clamp-shaped lock part 132 of the connection profile 130 has two inwardly curved strips 136, 138, the first strip 136 engaging at the flange outer side 120 into the groove 124 of the flange 114, and the second strip 138 engaging at the flange inner side 118 into the groove 124' of the flange 114. Such flanges 114 are preferably rolled as flat profiles and then welded together with a weld to form a double-T profile.

FIG. 6 shows an additional solution in order, starting from a standard double-T profile, to provide a sheet pile having coupling means on the longitudinal edges of the flanges in a simple manner. According to this solution, a bead 214 is applied by deposition welding to the flange outer side 220 along the longitudinal edge 222. This profile, too, can be hot-rolled as a double-T profile or be welded together from wide steel flats and/or steel plates.

It should be pointed out that of course only one, two, three or all four flange elements can be formed as described above and/or can have a corresponding connection part. Normally, however, all four flange ends are formed as described above, although usually only one of the two flanges 14, 14' has two welded-on connection profiles 30.

The invention claimed is:

1. A steel sheet pile in double-T form, comprising:

a web and two flanges, wherein each flange has an inner side facing the web, an outer side facing away from the web, and two longitudinal edges; and a coupling means for a connection profile along at least one longitudinal edge of at least one flange, said coupling means being formed by a milled groove, which extends in the outer side of said at least one flange along said at least one longitudinal edge to which said connection profile is to be connected, and has a substantially V-shaped cross section with an opening width b≦1.5·e and with a depth t≦0.5·e, wherein e is the thickness of the flange in the direct vicinity of the groove.

2. The sheet pile according to claim 1, wherein the groove has a rounded groove bottom.

3. The sheet pile according to claim 1, wherein the groove has a flat groove bottom.

4. The sheet pile according to claim 1, wherein the flange has a thickness e in the direct vicinity of the groove and the groove has an opening width b, wherein:

$$(0.5\cdot e)\leqq b\leqq(1.5\cdot e).$$

5. The sheet pile according to claim 4, wherein:

$$(0.9\cdot e)\leqq b\leqq(1.1\cdot e).$$

6. The sheet pile according to claim 4, wherein the flange has a thickness e in the direct vicinity of the groove and the groove has a depth t, wherein:

$$10\text{ mm}\leqq t\leqq(0.5\cdot e).$$

7. The sheet pile according to claim 4, wherein the groove is located at a distance s from the longitudinal edge of the flange, wherein:

$$4\ \text{mm} \leqq s \leqq 12\ \text{mm}.$$

8. The sheet pile according to claim 1, wherein the groove has a first groove flank situated closest to the longitudinal edge of the flange, this groove flank defining an angle α with the flange outer side, wherein:

$$40° \leqq \alpha \leqq 50°.$$

9. The sheet pile according to claim 1, wherein the groove has a first groove flank situated closest to the longitudinal edge of the flange and a second groove flank situated opposite the first, and the second groove flank defines an angle β with the flange outer side, wherein:

$$40° \leqq \beta \leqq 90°.$$

10. The sheet pile according to claim 9, wherein:

$$40° \leqq \beta \leqq 50°.$$

11. The sheet pile according to claim 1, wherein the groove is arranged in a thickened flange end.

12. The sheet pile according to claim 11, wherein the flange end is thickened in a wedge shape towards the outer side of the flange and has its maximum thickness (e) at the longitudinal edge of the flange.

13. The sheet pile according to claim 1, wherein the outer side of the flange is substantially concave, and the flange has its greatest thickness along its longitudinal edges.

14. The sheet pile according to claim 1, wherein the groove is arranged in a tapered flange end.

15. The sheet pile according to claim 1, wherein at least one flange has a groove in its inner side, along at least one longitudinal edge.

16. The sheet pile according to claim 1 associated with a connection profile which has a clamp-shaped lock part which is pushed over the longitudinal edge with the adjacent groove, wherein the groove has a first groove flank situated closest to the longitudinal edge of the flange and a second groove flank situated opposite the first, and the clamp-shaped lock part has an inwardly curved strip which engages at the flange outer side into the groove of the flange and has a terminal edge which is situated directly opposite the second groove flank.

17. The sheet pile according to claim 16, wherein a weld seam is laid in a wedge-shaped gap which is formed between the second groove flank and an outer side of the terminal edge.

18. The sheet pile according to claim 16, wherein the terminal edge of the inwardly curved strip has a centre plane which is approximately perpendicular to the second groove flank.

19. The sheet pile according to claim 16, wherein the clamp-shaped lock part forms a lock chamber which is rearwardly bounded by a lock rear wall which is situated opposite the longitudinal edge of the flange.

20. The sheet pile according to claim 19 wherein the lock rear wall is at a distance of 1 mm to 5 mm from the longitudinal edge of the flange if the terminal edge bears against the second groove flank.

21. The sheet pile according to claim 20, wherein the terminal edge is at a distance of less than 5 mm from the second groove flank if the lock rear wall bears against the longitudinal edge of the flange.

* * * * *